US008251843B1

(12) United States Patent
Goeders

(10) Patent No.: US 8,251,843 B1
(45) Date of Patent: Aug. 28, 2012

(54) WARNING MAT FOR PITCHING MOUND

(75) Inventor: John J. Goeders, Altoona, IA (US)

(73) Assignee: True Pitch, Inc., Altoona, IA (US)

( * ) Notice: Subject to any disclaimer, the term of this patent is extended or adjusted under 35 U.S.C. 154(b) by 0 days.

(21) Appl. No.: 13/267,589

(22) Filed: Oct. 6, 2011

(51) Int. Cl.
*A63B 71/00* (2006.01)

(52) U.S. Cl. ..... 473/497

(58) Field of Classification Search ..... 473/497, 473/422, 451, 452, 499–501
See application file for complete search history.

(56) References Cited

U.S. PATENT DOCUMENTS

| | | | | | |
|---|---|---|---|---|---|
| 3,236,520 | A | * | 2/1966 | Friedman | 473/452 |
| 4,063,729 | A | * | 12/1977 | Hollaway | 473/497 |
| 4,306,718 | A | * | 12/1981 | Goeders | 473/497 |
| 4,561,653 | A | * | 12/1985 | Wright | 473/497 |
| 4,666,155 | A | * | 5/1987 | Stille | 473/497 |
| 4,749,223 | A | * | 6/1988 | Goeders | 473/497 |
| 5,467,977 | A | * | 11/1995 | Beck | 473/497 |
| 5,707,305 | A | * | 1/1998 | Goeders et al. | 473/497 |

* cited by examiner

*Primary Examiner* — Mitra Aryanpour
(74) *Attorney, Agent, or Firm* — Zarley Law Firm, P.L.C.

(57) ABSTRACT

A portable pitching mound having a base with a lower peripheral edge that is flush to the ground and an arcuate cross section to form a shell. A warning mat is attached to at least a portion of the base. Attached to the base and covering the warning mat is a layer of frictional material.

5 Claims, 1 Drawing Sheet

WARNING MAT FOR PITCHING MOUND

BACKGROUND OF THE INVENTION

This invention is directed toward a portable pitching mound for both indoor and outdoor use and more specifically a portable pitching mound having a warning mat.

Portable pitching mounds are well known in the art and generally include a base covered by turf such as astro-turf with a pitching rubber attached. The mounds are of many shapes and structures. While these mounds have served many purposes, there are still problems that exist in the art.

One problem occurs, particularly in areas where players wear spikes, when through use, the turf wears through to the base which is typically made of fiberglass. When this occurs a player's cleat can either slip on the fiberglass or become tangled in the turf, leading to potential injury.

Further, when this occurs, the mound becomes inoperable until repaired. Accordingly, a need exists in the art for a device that addresses this problem.

Therefore, an objective of this invention is to provide a portable mound having a warning mat.

This and other objectives will be apparent to one of ordinary skill in the art based on the following written description, drawings and claims.

SUMMARY OF THE INVENTION

A portable pitching mound having a base with a lower peripheral edge that is flush to the ground and an arcuate cross section to form a shell. A warning mat is attached to at least a portion of the base. Attached to the base and covering the warning mat is a layer of frictional material.

DETAILED DESCRIPTION OF THE PREFERRED EMBODIMENTS

Figure 1:
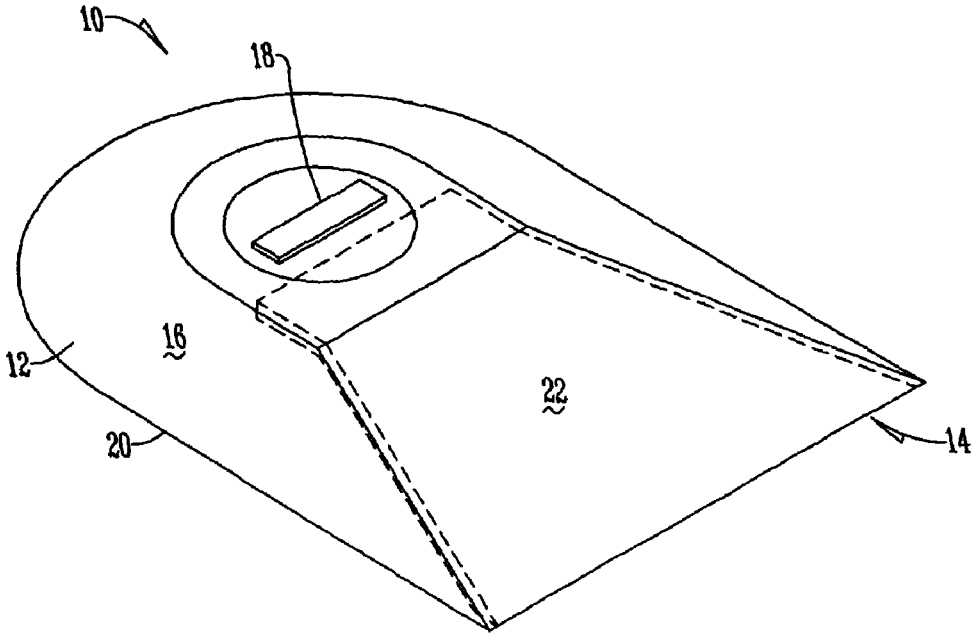
FIG. 1 is a perspective view of a pitching mound.
Figure 2:
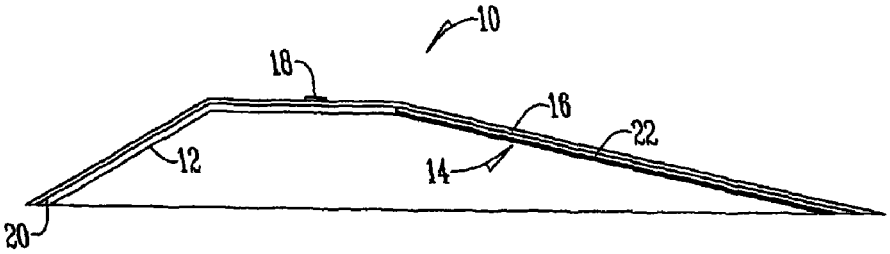
FIG. 2 is a sectional view of a pitching mound.

Referring to the Figures, a portable pitching mound 10 has a base 12, a warning pad or mat 14, and a turf layer 16 made of a frictional material such as AstroTurf®. Mounted to the top of the mound 10 is a pitching rubber 18.

The base 12, which is preferably made of Fiberglass®, is of any size, shape, or structure having a lower peripheral edge 20 and an arcuate cross section that forms a shell. The base 12 is made of a single piece or alternatively multiple pieces. Preferably, the lower peripheral edge 20 is flush with the ground or supporting surface to provide a smooth uninterrupted transition from the ground to the mound 10.

The warning mat 14 preferably is made of a rubber material such as concentrated recycled rubber protective matting. The mat 14 is attached to the base 12 in any manner such as with an adhesive material. While the mat 14 can cover the entire base 12, alternatively the mat covers a portion of the base 12 such as a section 22 from the pitching rubber 18 to the lower peripheral edge 20.

The layer of frictional material 16 is attached to the base 12, the mat 14, or both in any manner such as with an adhesive material, such that the mat 14 is disposed between layer 16 and base 12. The pitching rubber 18 is mounted to the base 12.

In operation, as a player pitches on the mound, portions of layer 16 begins to wear, warning mat 14 will be exposed which serves as an indication that it is time to replace layer 16. While layer 16 is being replaced, mat 14 protects base 12.

Accordingly, a portable pitching mound has been disclosed that, at the very least meets all the stated objectives.

What is claimed is:

1. A portable pitching mound, comprising:

a base having a lower peripheral edge that is flush with the ground to provide a smooth, uninterrupted transition from the ground to the portable pitching mound, a warning mat attached to the base, a layer of frictional material attached to the base that covers the mat, a pitching rubber attached to the base, wherein the warning mat covers a portion of the base from the pitching rubber to the lower peripheral edge that is flush with the ground, and wherein the layer of frictional material is attached to both of the warning mat and the base such that the mat is disposed between the layer of frictional material and the base.

2. The mound of claim 1 wherein the mat is made of rubber.

3. The mound of claim 1 wherein the mat is made of concentrated protective rubber.

4. The mound of claim 3 wherein the warning mat is connected to the base with an adhesive material.

5. The mound of claim 1 wherein the layer of frictional material is adhesively attached to both of the warning mat and the base.

* * * * *